US011832768B2

(12) United States Patent
Cates-Fox et al.

(10) Patent No.: US 11,832,768 B2
(45) Date of Patent: Dec. 5, 2023

(54) RETRACTABLE SUPPORT HANDLE

(71) Applicants: Michelle Cates-Fox, Las Vegas, NV (US); Aaron Bivens, Las Vegas, NV (US); Benjamin Girardin, Las Vegas, NV (US)

(72) Inventors: Michelle Cates-Fox, Las Vegas, NV (US); Aaron Bivens, Las Vegas, NV (US); Benjamin Girardin, Las Vegas, NV (US)

( * ) Notice: Subject to any disclaimer, the term of this patent is extended or adjusted under 35 U.S.C. 154(b) by 0 days.

(21) Appl. No.: 17/735,549

(22) Filed: May 3, 2022

(65) Prior Publication Data

US 2022/0354321 A1 Nov. 10, 2022

Related U.S. Application Data

(60) Provisional application No. 63/183,776, filed on May 4, 2021.

(51) Int. Cl.
*A47K 17/02* (2006.01)

(52) U.S. Cl.
CPC ..... *A47K 17/024* (2013.01)

(58) Field of Classification Search
CPC ..... A47K 17/024
USPC ..... 4/576.1
See application file for complete search history.

(56) References Cited

U.S. PATENT DOCUMENTS

| | | | | |
|---|---|---|---|---|
| 3,568,220 | A * | 3/1971 | Dees | A47K 17/022 4/576.1 |
| 4,932,090 | A | 6/1990 | Johansson | |
| 5,306,217 | A * | 4/1994 | Bracone | A63B 21/157 4/496 |
| 5,586,352 | A | 12/1996 | O'Brien et al. | |
| 5,590,440 | A * | 1/1997 | Pelt | A47K 17/024 16/342 |
| 9,205,018 | B2 * | 12/2015 | Hinkle | A61H 3/00 |
| 10,143,343 | B1 * | 12/2018 | Miller, Sr. | A47K 17/024 |
| 2007/0186348 | A1 | 8/2007 | Banks | |
| 2007/0251053 | A1 | 11/2007 | Miller | |
| 2008/0093518 | A1 * | 4/2008 | Roth | A47K 17/024 248/205.5 |
| 2008/0098510 | A1 | 5/2008 | O'Brien et al. | |
| 2010/0251469 | A1 * | 10/2010 | Kim | A47K 17/024 4/254 |
| 2011/0084578 | A1 | 4/2011 | Newkirk et al. | |

(Continued)

*Primary Examiner* — Christine J Skubinna
(74) *Attorney, Agent, or Firm* — Boudwin Intellectual Property Law, LLC; Daniel Boudwin

(57) ABSTRACT

A retractable support handle includes a mounting bracket having a rear plate configured to secure to a mounting surface via one or more fasteners. A support bar includes a first end connected to a spring-loaded hinge within the mounting bracket and a second end extending outwardly from a slot disposed on a front plate of the mounting bracket. The support bar is rotatable between a raised vertical position and a lowered horizontal position. The spring-loaded hinge is configured to automatically return the support bar to the raised vertical position when the retractable support handle is not in use. A user may grasp and rotate the support bar to the lowered horizontal position to provide a support handle when needed. When the user releases the support bar, the spring-loaded hinge automatically retracts the support bar to the raised vertical position.

7 Claims, 9 Drawing Sheets

(56) References Cited

U.S. PATENT DOCUMENTS

| | | | | |
|---|---|---|---|---|
| 2012/0227169 | A1* | 9/2012 | Thyren | A47K 17/028 4/254 |
| 2016/0262586 | A1* | 9/2016 | Castellini | A47K 3/281 |
| 2019/0024455 | A1* | 1/2019 | Reid | A47K 17/00 |
| 2022/0071456 | A1* | 3/2022 | Meyers | A47K 3/12 |
| 2023/0081106 | A1* | 3/2023 | Shantha | E03D 11/04 |

* cited by examiner

RETRACTABLE SUPPORT HANDLE

CROSS REFERENCE TO RELATED APPLICATIONS

This application claims the benefit of U.S. Provisional Application No. 63/183,776 filed on May 4, 2021. The above identified patent application is herein incorporated by reference in its entirety to provide continuity of disclosure.

BACKGROUND OF THE INVENTION

The present invention relates to a retractable support handle. More specifically, the present invention provides a retractable support handle for assisting individuals with moving from a seated position to a standing position, wherein that the retractable support handle is movable between a raised vertical position for storage and a lowered horizontal position for use.

Many individuals, including elderly individuals and those with mobility issues, find it difficult to stand up from a seated position. For example, it can be difficult to stand up from a seated position while seated on the toilet. Some bathrooms, such as handicap accessible stalls in public restrooms, provide support devices for individuals. However, these are a lacking. Typical support devices only consist of a rigid, nonmoving bar that is attached to a wall adjacent the toilet. It can be difficult for individuals to reach next to them to assist themselves with standing. The nonmoving bar can take up space in the bathroom and make it difficult for individuals to maneuver. It can also be difficult to use a fixed bar device that cannot move and adjust as the user repositions themselves.

In order to address these concerns, the present invention provides an improved retractable support handle that can replace or supplement the traditional static grab bar. The retractable support handle is positioned in front of the seated user. Further, the retractable support handle can extend down from a retracted or raised vertical position to a deployed lower horizontal position, whereby the user can grab the retractable support handle and pull themselves forward to easily raise themselves to a standing position, preserving their confidence and independence. Further, the retractable support handle includes a spring-loaded hinge that automatically retracts to the support handle to a raised vertical position when not in use. In this way, the user has more room to comfortably move about the restroom.

In light of the devices disclosed in the known art relating to static support handles, it is submitted that the present invention substantially diverges in design elements from the known art and consequently it is clear that there is a need in the art for an improvement to existing support handles, particularly in bathrooms where current static grab-bar type support devices are inadequate. In this regard, the present invention substantially fulfills these needs.

SUMMARY OF THE INVENTION

In view of the foregoing disadvantages inherent in the known types of static support devices now present in the prior art, the present invention provides a retractable support handle wherein the same can be utilized to provide an improved handle for individuals which automatically retracts to a raised position for storage when not in use.

In one embodiment, the retractable support handle generally includes a mounting bracket having a rear plate configured to secure to a mounting surface via one or more fasteners. A spring-loaded hinge is affixed to the mounting bracket. A support bar includes a first end connected to the spring-loaded hinge and a second end extending outwardly from a slot disposed on a front plate of the mounting bracket. The support bar is rotatable between a raised vertical position and a lowered horizontal position. The spring-loaded hinge is configured to bias the support bar to the raised vertical position.

One object of the present invention is to provide a retractable support handle that can be lowered to a horizontal deployed position when the user rotates the support handle, which then automatically retracts to the raised vertical position when the user releases the support handle.

Other objects, features, and advantages of the present invention will become apparent given the following detailed description taken in conjunction with the accompanying drawings.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings.

DETAILED DESCRIPTION OF THE INVENTION

Reference is made herein to the attached figures. For the purposes of presenting a brief and clear description of the present invention, the preferred embodiment will be discussed as used for providing a retractable support handle for assisting individuals with independently moving from a seated position to a standing position, particularly in a bathroom when seated on a toilet. The figures are intended for representative purposes only and should not be considered to be limiting in any respect. Any figures that include dimensions are for example purposes and are not meant to limit the present invention to any particular dimensions.

Figure 1:
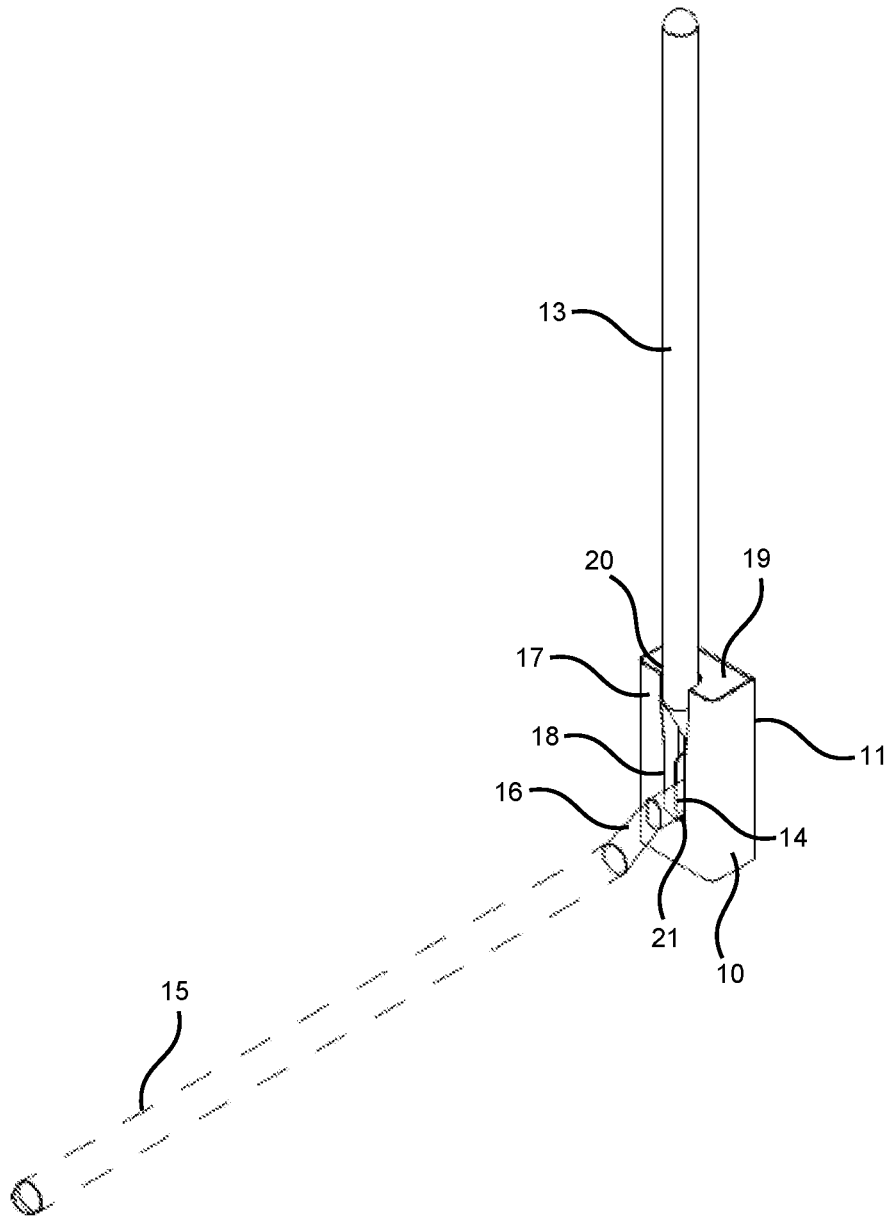
FIG. 1 shows a perspective view of an embodiment of the retractable support handle.

Referring now to FIG. 1, there is shown a perspective view of an embodiment of the retractable support handle. The retractable support handle includes a mounting bracket 10 which includes a rear plate 11 configured to secure to a mounting surface via one or more fasteners. The mounting bracket 10 provides a mechanism for securing the support bar 13 and for attaching the support bar 13 to a mounting surface. Some examples of possible mounting surfaces include a wall, a bathroom stall, or any other structural installation. In one embodiment, the fasteners may include threaded anchor fasteners that extended into the mounting surface. In other embodiments, the fasteners can be screws, magnets, or any other combination of suitable fasteners for securing the mounting plate to a wall or other mounting surface.

The mounting bracket 10 has a front plate 17 which includes a slot 18. The slot 18 forms an opening in the front plate 17, which extends from a lower edge 21 of the slot 18 upwardly through a top wall 19 of the mounting bracket 10. In the shown embodiment, the mounting bracket 10 further includes a top wall 19 affixed to the upper edge of the rear plate 11. The top wall 19 includes an indentation 20 that receives the second end 15 of the support bar 13 when the support bar 13 is in the raised vertical position, whereby the support bar 13 extends upwardly out up the upper opening of the slot 18. This allows the support bar 13 to retract closer to the mounting surface for more compact storage, such that it is not in the way when not being used. In some embodiments, the exterior surface of the second end 15 of the support bar 13 aligns flush with the front plate 17 of the mounting bracket 10 when the support bar 13 is in the raised position. This further reduces the amount of space the retracted support bar 13 occupies. The support bar 13 has an elongated linear shape 13A or the like.

Figure 2:
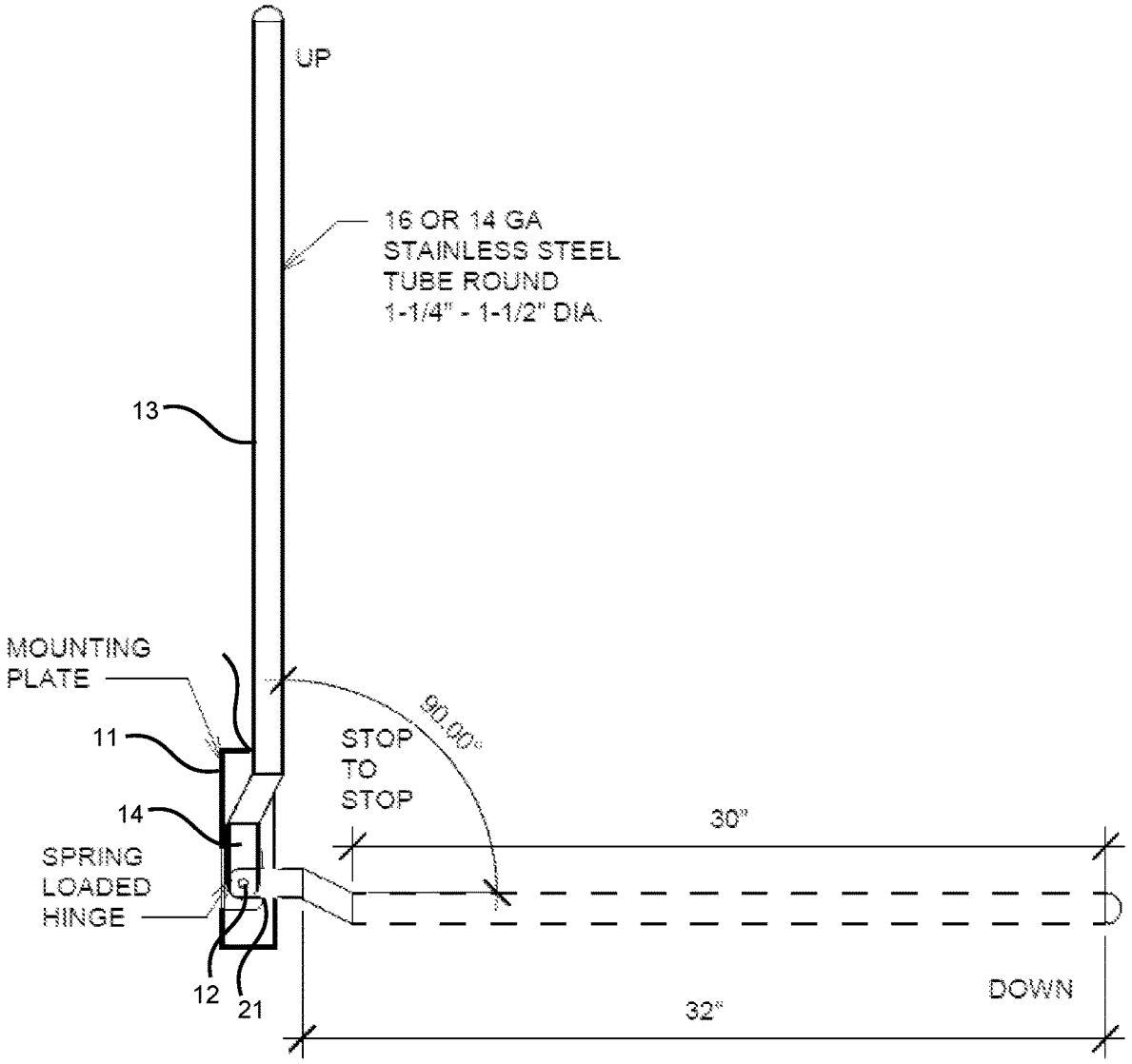
FIG. 2 shows a cross-sectional side elevation view of an embodiment of the retractable support handle.

The mounting bracket 10 further includes a spring-loaded hinge 12 to which the support bar 13 is connected. The spring-loaded hinge 12 and the attachment to the first end 14 of the support bar 13 is shown more clearly in FIG. 2, which shows a cross-sectional side elevation view of an embodiment of the retractable support handle. In the shown embodiment, the spring-loaded hinge 12 is disposed within an interior area of the mounting bracket 10. In other words, the structure of the mounting bracket 10 is such that a cover is formed around the spring-loaded hinge 12. This shields the spring-loaded hinge 12 from exterior access and prevents the user's hand from being caught in the spring-loaded hinge 12.

The support bar 13 includes a first end 14 connected to the spring-loaded hinge 12 and a second end 15 extending outwardly from the slot 18 disposed on the front plate 17 of the mounting bracket 10. The support bar 13 is rotatable between a raised vertical position and a lowered horizontal position. The spring-loaded hinge 12 is configured to bias the support bar 13 to the raised vertical position. An amount of pressure or weight applied by the user to the support bar 13 allows it to rotate down to the horizontal position for use. The spring-loaded hinge 12 causes the support bar 13 to automatically retract to the raised vertical position when the user releases the support bar 13. In one embodiment, the support bar 13 requires approximately five pounds of weight applied to its second end 15 in order to overcome the spring force of the spring-loaded hinge 12 and rotate the support bar 13 to the lowered horizontal position. However, the spring-loaded hinge 12 can be calibrated for any desired amount of resistance or spring force. For example, a strong enough spring force also allows the user to pull the support bar 13 toward themselves and let the spring force assist in pulling themselves forward and upward to a standing position as the support bar 13 automatically retracts.

Referring now to FIGS. 2-5, there are shown elevation views of an embodiment of the retractable support handle. In the shown embodiment, the first end 14 of the support bar 13 and the second end 15 of the support bar 13 are each connected to opposing ends of an angled connector 16, such that the second end 15 of the support bar 13 is offset from the first end 14 of the support bar 13. In this embodiment, the first end 14 of the support bar 13 rests on a lower edge 21 of the slot 17 on the front plate 18 of the mounting bracket 10 when the support bar 13 is in the lowered horizontal position. This configuration allows the particular angle of the angled connector 16, and correspondingly the offset distance, to determine the height of the support bar 13 with respect to the floor when the support bar 13 is in the lowered horizontal position. As such, the angle of the connector 16 and offset distance can be chosen to achieve a desired height for the support bar 13 when it is in the lowered horizontal position.

Figure 3:
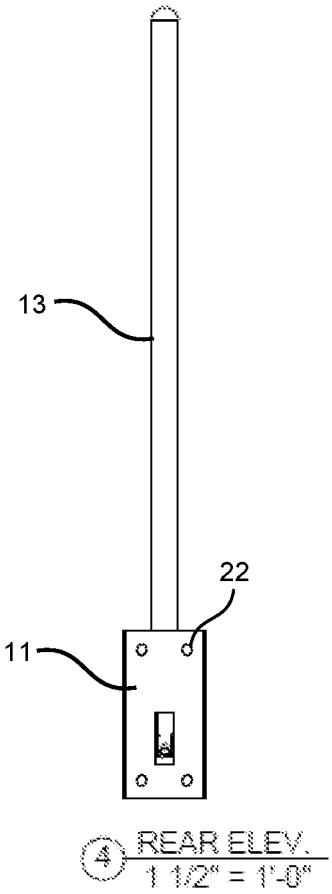
FIG. 3 shows a rear elevation view of an embodiment of the retractable support handle.
Figure 4:
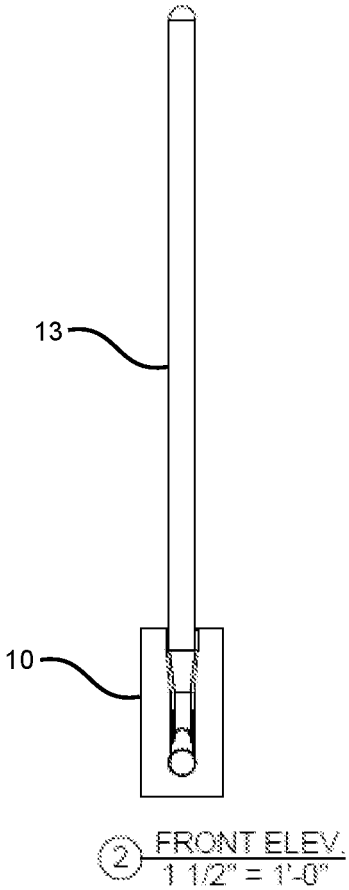
FIG. 4 shows a front elevation view of an embodiment of the retractable support handle.
Figure 5A:
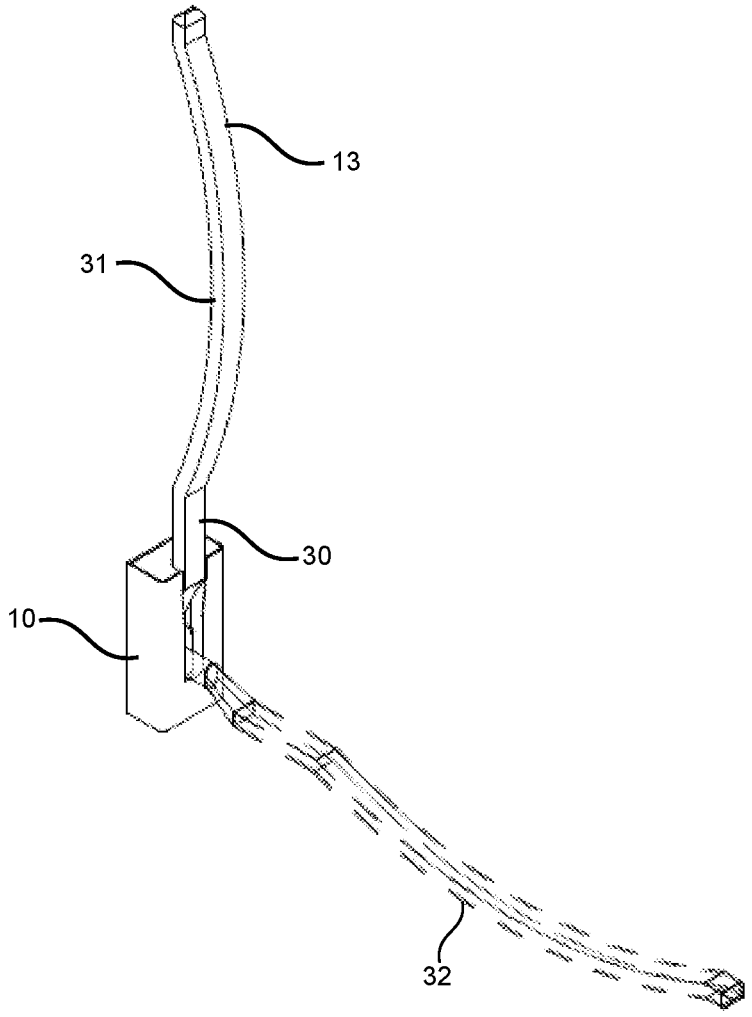
FIG. 5A shows an alternate embodiment of the retractable support handle having a first alternate support handle.
Figure 5B:
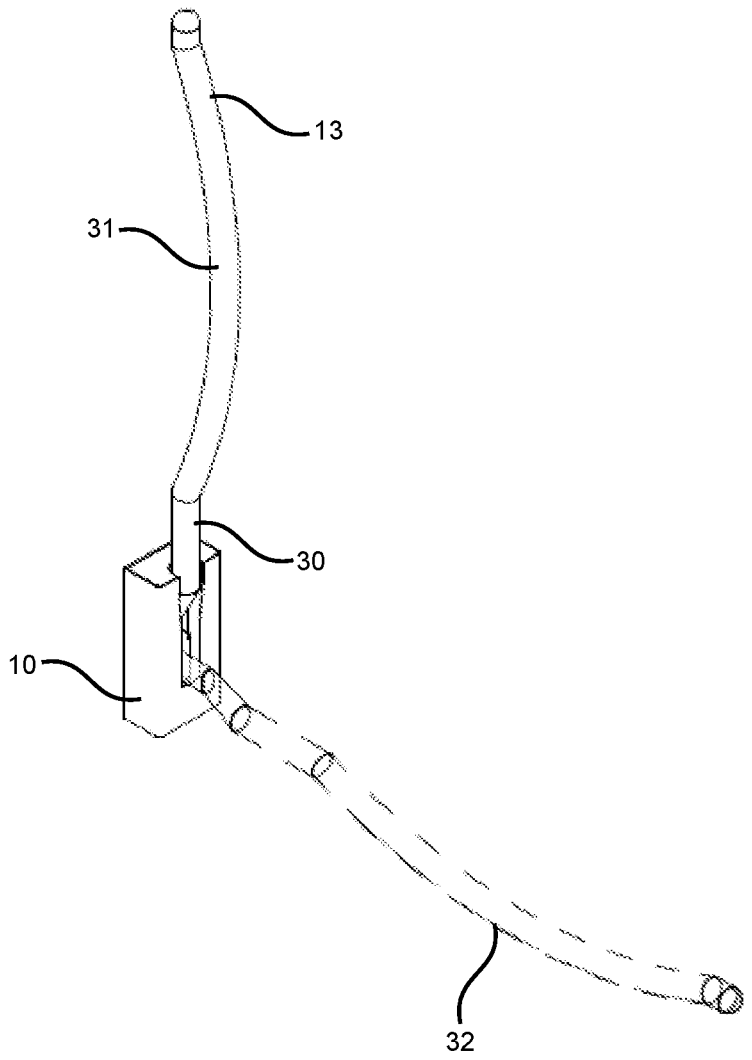
FIG. 5B shows an alternate embodiment of the retractable support handle having a second alternate support handle.
Figure 5C:
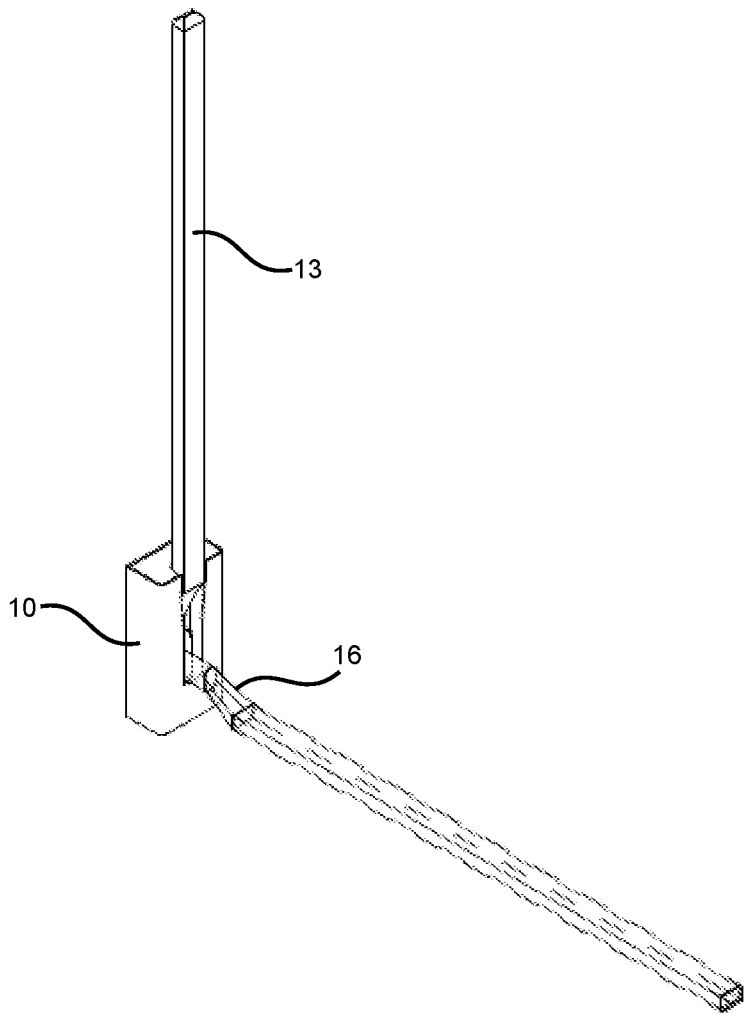
FIG. 5C shows an alternate embodiment of the retractable support handle having a third alternate support handle.
Figure 5D:
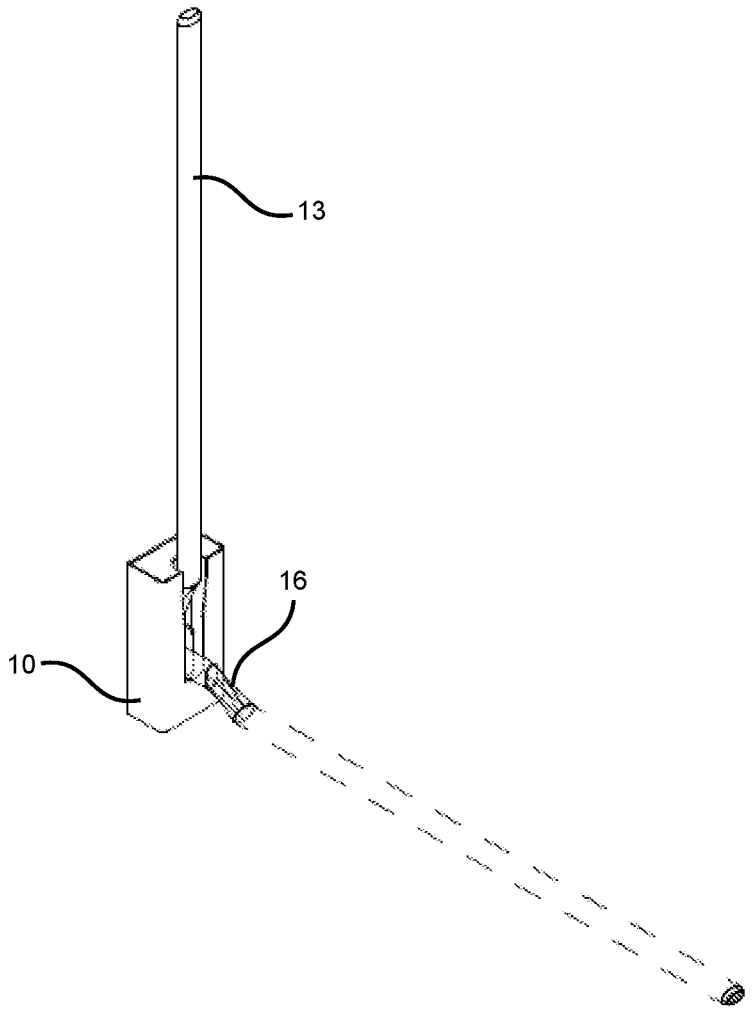
FIG. 5D shows an alternate embodiment of the retractable support handle having a fourth alternate support handle.
Figure 5E:
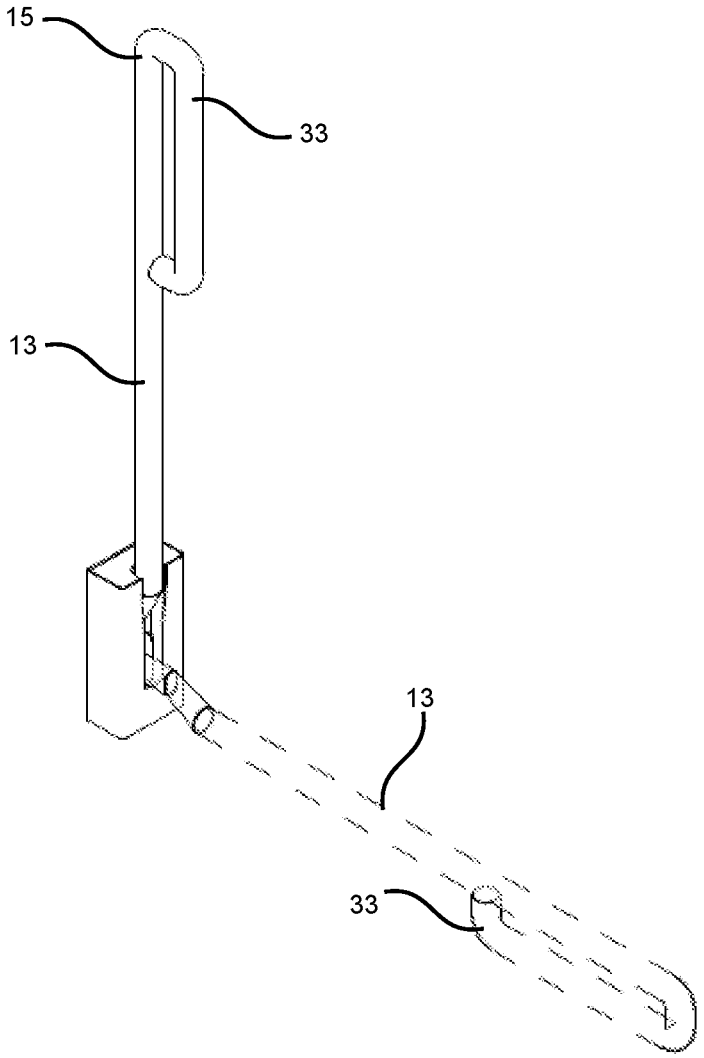
FIG. 5E shows an alternate embodiment of the retractable support handle having a fifth alternate support handle.
Figure 5F:
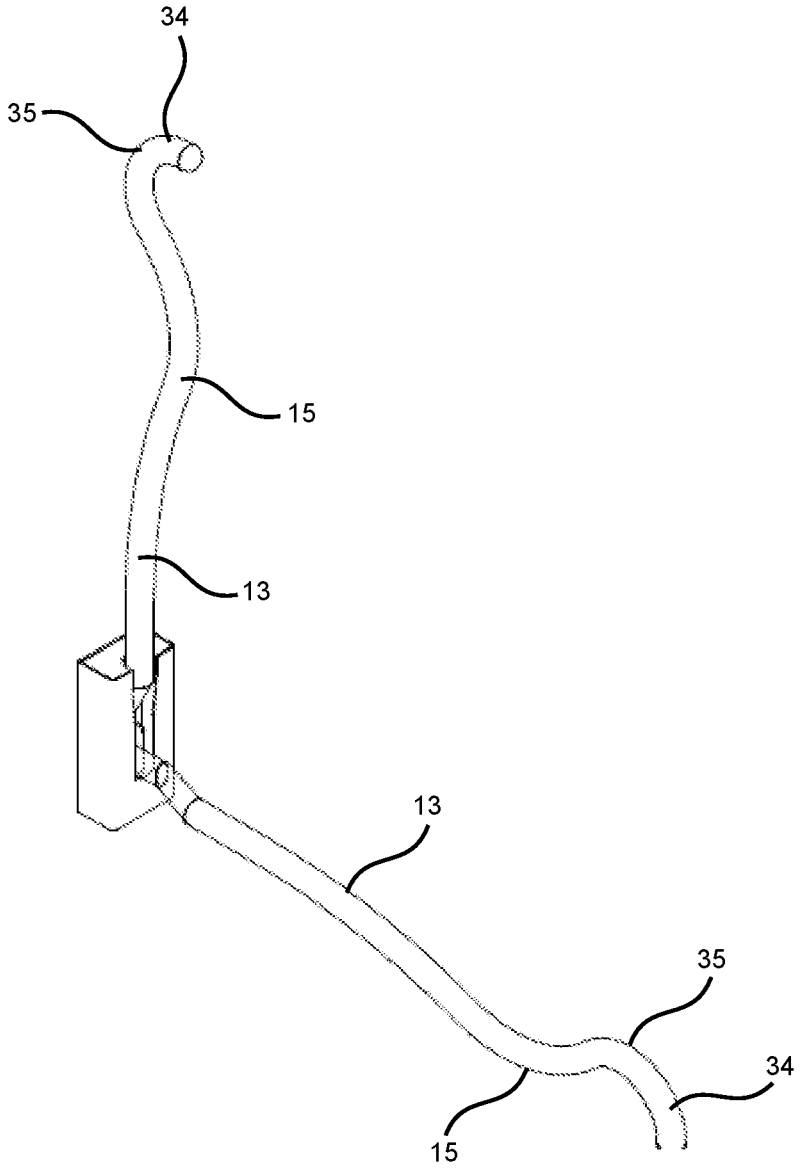
FIG. 5F shows an alternate embodiment of the retractable support handle having a sixth alternate support handle.

As shown in FIG. 3, the rear mounting plate of the mounting bracket 10 may include mounting apertures 22 which can receive mounting fasteners. For example, the mounting fasteners may include threaded anchor fasteners, but any suitable fastener may be utilized. In another embodiment, the mounting apertures 22 can be replaced with strong magnets that can secure the mounting bracket 10 to a corresponding magnetic surface.

Referring now to FIGS. 5A-5F, there are shown various embodiments of the retractable support handle, with different configurations for the handle. The support bar 13 can include a rectangular cross-section, a circular cross-section, or other desired cross-sectional shapes. In some embodiments, the support bar 13 is linear, such as the embodiments shown in FIGS. 5C and 5D. In other embodiments, the support bar 13 can be curved in a desired way. For example, in the embodiments shown in FIGS. 5A and 5B, the second end 15 of the support bar 13 includes a straight portion 30 having a first end affixed to the angled connector 16 and a curved handle portion 31 affixed to a second end of the straight portion 30, such that an apex 32 of the curved portion extends downwardly when the support bar 13 is in the lowered horizontal position. This can provide a lower position which the user may grasp if they need more leverage to support themselves. As another example, in the embodiment shown 5E, the second end 15 of the support bar 13 curves around and back toward the mounting bracket, forming a grip loop 33 at a distal end of the support bar 13. This grip loop 33 provides upper and lower grasping points so the user can grip either one that is more comfortable. As another example, the second end 15 of the support bar 13 includes a curved grip member 34, such that an apex 35 of the curved grip member 34 extends upwardly when the support bar is in the lowered horizontal position. This configuration of the curved grip member 34 can provide a more ergonomic grasping point that can help users return themselves to the standing position as the support bar 13 retracts.

In one example use for the present invention, a user seated on a toilet or otherwise in a seated position can grasp the support bar 13 and rotate the support bar 13 downward to the lowered horizontal position. The user may then rest their weight on the support bar 13 and support themselves as they move from a seated position to a standing position. The support bar 13 then automatically releases and returns to the raised vertical position after the user releases the support bar 13. The spring force of the spring-loaded hinge assists users with pulling themselves upward and forward to a standing position. In this way, the adjustable support handle can be installed adjacent to or in replacement of an existing static bar and utilized by individuals to assist with standing up from the toilet, whereby the support bar 13 automatically returns to a compact stored position after use.

It is therefore submitted that the present invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A retractable support handle, comprising:

a mounting bracket comprising a rear plate configured to secure to a mounting surface via one or more fasteners;

a spring-loaded hinge affixed to the mounting bracket; and a support bar comprising a first end connected to the spring-loaded hinge and a second end extending outwardly from a slot disposed on a front plate of the mounting bracket;

wherein the support bar is rotatable between a raised vertical position and a lowered horizontal position;

wherein the spring-loaded hinge is configured to bias the support bar to the raised vertical position; wherein the mounting bracket further comprises a top wall affixed to an upper edge of the rear plate, the top wall comprising an indentation that receives the second end of the support bar when the support bar is in the raised vertical position;

wherein the support bar comprises an elongated linear shape;

wherein the one or more fasteners includes one or more magnetic fasteners disposed on a rear surface of the rear plate of the mounting bracket;

wherein the first end of the support bar and the second end of the support bar are each connected to opposing ends of an angled connector, such that the second end of the support bar is offset from the first end of the support bar;

wherein the second end of the support bar curves around and back toward the mounting bracket, forming a grip loop at a distal end of the support bar; and wherein the second end of the support bar includes a curved grip member, such that an apex of the curved grip member extends upwardly when the support bar is in the lowered horizontal position.

2. The retractable support handle of claim 1, wherein the first end of the support bar rests on a lower edge of the slot on the front plate of the mounting bracket when the support bar is in the lowered horizontal position.

3. The retractable support handle of claim 1, wherein an exterior surface of the second end of the support bar aligns flush with the front plate of the mounting bracket when the support bar is in the raised position.

4. The retractable support handle of claim 1, wherein the one or more fasteners includes threaded anchor fasteners that are insertable through apertures in the rear plate of the mounting bracket.

5. The retractable support handle of claim 1, wherein the support bar comprises a circular cross section.

6. The retractable support handle of claim 1, wherein the support bar comprises a rectangular cross section.

7. The retractable support handle of claim 1, wherein the second end of the support bar comprises a straight portion having a first end affixed to the angled connector and a curved handle portion affixed to a second end of the straight portion, such that an apex of the curved portion extends downwardly when the support bar is in the lowered horizontal position.

* * * * *